US009120063B2

(12) United States Patent
Knauer

(10) Patent No.: US 9,120,063 B2
(45) Date of Patent: Sep. 1, 2015

(54) STIRRER

(75) Inventor: Jochen Friedrich Knauer, Homburg (DE)

(73) Assignee: Ecolab USA Inc., St. Paul, MN (US)

( * ) Notice: Subject to any disclaimer, the term of this patent is extended or adjusted under 35 U.S.C. 154(b) by 169 days.

(21) Appl. No.: 13/821,604

(22) PCT Filed: Sep. 7, 2011

(86) PCT No.: PCT/EP2011/065491

§ 371 (c)(1),
(2), (4) Date: Apr. 30, 2013

(87) PCT Pub. No.: WO2012/032090

PCT Pub. Date: Mar. 15, 2012

(65) Prior Publication Data

US 2013/0294190 A1 Nov. 7, 2013

(30) Foreign Application Priority Data

Sep. 10, 2010 (DE) ..... 10 2010 037 473

(51) Int. Cl.

| | |
|---|---|
| ***B01F 7/00*** | (2006.01) |
| ***B01F 3/04*** | (2006.01) |
| ***B01F 7/16*** | (2006.01) |

(52) U.S. Cl.

CPC ..... *B01F 7/007* (2013.01); *B01F 3/04539* (2013.01); *B01F 7/00316* (2013.01); *B01F 7/00633* (2013.01); *B01F 7/1625* (2013.01); *B01F 2003/04546* (2013.01); *B01F 2003/04695* (2013.01); *B01F 2003/04865* (2013.01); *B01F 2215/0003* (2013.01); *B01F 2215/0052* (2013.01)

(58) Field of Classification Search

CPC ..... B01F 7/007
USPC ..... 366/169.2; 261/87
See application file for complete search history.

(56) References Cited

U.S. PATENT DOCUMENTS

| | | | | | |
|---|---|---|---|---|---|
| 975,380 | A | * | 11/1910 | Berntson | 366/164.4 |
| 1,242,445 | A | * | 10/1917 | Ittner | 261/87 |
| 2,203,673 | A | * | 6/1940 | Cornell | 366/169.2 |
| 2,404,679 | A | | 7/1946 | Andron | |

(Continued)

FOREIGN PATENT DOCUMENTS

| | | |
|---|---|---|
| EP | 1479758 | 11/2004 |
| SU | 1454367 | 1/1989 |
| WO | 2012032090 | 3/2012 |

OTHER PUBLICATIONS

International Search Report and Written Opinion for PCT/EP2011/065491 Issued Mar. 12, 2013.

*Primary Examiner* — David Sorkin
(74) *Attorney, Agent, or Firm* — Fredrikson & Byron, P.A.

(57) ABSTRACT

A stirrer having a motor; a hollow shaft that is drivable via the motor and is provided with at least one additive outlet opening, via which an additive passed through the hollow shaft can be discharged; and a rotor arranged on the hollow shaft and having rotor blades, characterized in that a second rotor having rotor blades is provided on the hollow shaft at a distance from the first rotor, and in that the at least one additive outlet opening is provided between the two rotors, wherein the rotors are designed and drivable such that, during operation, a negative pressure and a centrifugal force are generated in the intermediate space defined between the rotors.

14 Claims, 3 Drawing Sheets

(56) References Cited

U.S. PATENT DOCUMENTS

| | | | |
|---|---|---|---|
| 2,928,661 | A | 3/1960 | MacLaren |
| 3,400,918 | A | 9/1968 | MacLaren |
| 3,776,531 | A | 12/1973 | Ebner |
| 5,478,535 | A | 12/1995 | Fierz |
| 6,158,722 | A | 12/2000 | Gigas |
| 2006/0176771 | A1 | 8/2006 | Adams |

* cited by examiner

STIRRER

CROSS-REFERENCE TO RELATED APPLICATIONS

This application is a 35 U.S.C. §371 U.S. National Stage of PCT/EP2011/065491, filed Sep. 7, 2011, which claims priority to German Application No. DE 10 2010 037 473.3, filed Sep. 10, 2010. The entire content of each of the aforementioned patent applications is incorporated herein by reference.

BACKGROUND OF THE INVENTION

1. Field of the Invention

The present invention relates to a stirrer having a motor, a hollow shaft that is drivable via the motor and is provided with at least one additive outlet opening, through which an additive passed through the hollow shaft can be discharged, and a rotor arranged on the hollow shaft and having rotor blades.

2. Background and Relevant Art

Such stirrers are known in a wide variety of configurations in the prior art and are used in different technical fields. For example, DE-A-25 11 717 discloses a stirrer having a motor-operated hollow shaft and a rotor fastened thereto. The rotor is provided with holes or additive outlet openings, via which an additive in the form of air passed through the hollow shaft can be introduced into a liquid to be treated in order to aerate it, as is required for example in the treatment of biological slurry. DE-U-93 06 907 describes a liquid manure aeration device having a rotor driven via a hollow shaft, wherein additives in the form of air or chemicals can be drawn in by the hollow shaft simply under the effect of the negative pressure generated by the rotor and can be admixed via a corresponding additive outlet opening provided in the lower region of the hollow shaft. However, in the case of the known stirrers, both the intermixing of the medium to be treated and the feeding of the additive to be admixed are capable of improvement.

Proceeding from this prior art, it is an object of the present invention to create a stirrer of the type mentioned at the beginning, which has a simple structure and ensures very good intermixing of the medium to be treated and proper feeding of the additive to be admixed.

BRIEF SUMMARY OF THE INVENTION

In order to achieve this object, the present invention provides a stirrer of the type mentioned at the beginning, which is characterized in that a second rotor having rotor blades is provided on the hollow shaft at a distance from the first rotor, and in that the at least one additive outlet opening is provided between the two rotors, wherein the rotors are designed and drivable such that, during operation, a negative pressure and a centrifugal force are generated in the intermediate space defined between the rotors.

On account of the fact that during operation of the stirrer a (static) negative pressure is generated in the intermediate space defined between the rotors, the medium to be treated is delivered automatically and continuously from outside into the intermediate space, and as a result very good intermixing is achieved. Furthermore, by virtue of the negative pressure prevailing in the intermediate space and the centrifugal force generated, the additive is sucked continuously and very effectively out of the at least one additive outlet opening, and this leads to very good and constant admixture of the additive. Overall, good intermixing of the medium to be treated and proper introduction of the additive can thus be ensured.

According to one refinement of the present invention, the rotors are connected to the hollow shaft so as to rotate therewith, wherein the rotor blades of the first rotor and the rotor blades of the second rotor are arranged so as to move in opposite directions. In other words, the rotor blades of the first rotor and the rotor blades of the second rotor are inclined in opposite directions. In this way, a very simple structure of the stirrer is achieved. The flow directions of the flows generated by the rotors are preferably directed in opposite directions to one another and/or preferably the suction sides of the rotors, in particular in the axial direction with respect to the hollow shaft, are provided on sides facing away from one another, while the pressure sides of the rotors face one another or are located between the rotors.

Preferably, the rotors are arranged in the region of the free end of the hollow shaft, so that they can be guided very close to the bottom of the particular container in which the medium to be treated is contained.

According to one refinement of the present invention, the hollow shaft and the rotor blades of the first rotor and of the second rotor are produced from plastics material. Accordingly, it is also possible to use the stirrer according to the invention to introduce very aggressive additives into the media to be treated, for example iron(III) chloride ($FeCl_3$), which is used in wastewater treatment for example for phosphate elimination.

Preferably, the at least one additive outlet opening is an elongate cutout which extends in particular in the direction of the hollow shaft axis. By way of such an elongate cutout, it is possible for the additive to be discharged very uniformly.

Advantageously, a plurality of additive outlet openings, which are arranged in a regularly distributed manner along the circumference of the hollow shaft, are provided.

The motor may be an electric motor. The motor can drive the hollow shaft directly. Alternatively, it is of course also possible for a corresponding transmission, for example a bevel gear transmission or the like, to be interposed.

According to one refinement of the present invention, the hollow shaft and the motor are arranged coaxially, wherein an additive feed line is connected in particular to the opposite side of the motor from the hollow shaft. In this way, a very simple structure of the stirrer according to the invention is produced.

The motor may be fastened to a mounting plate, so that the stirrer can be installed without problems.

BRIEF DESCRIPTION OF THE DRAWINGS

Further features and advantages of the present invention will become apparent by way of the accompanying description of a preferred embodiment of a stirrer according to the invention with reference to the accompanying drawing, in which.

DETAILED DESCRIPTION OF THE PREFERRED EMBODIMENTS

Figure 1:
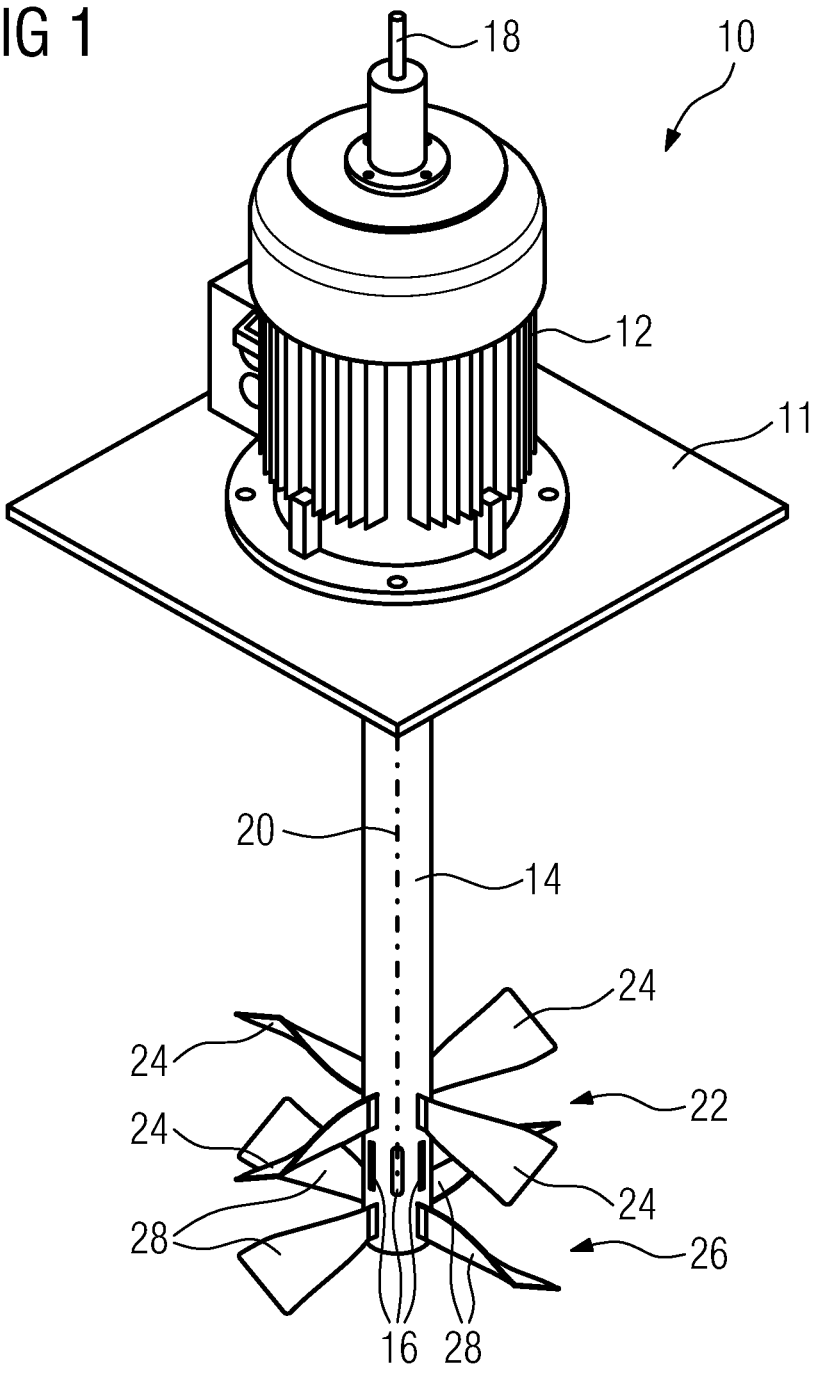
FIG. 1 is a perspective view of a stirrer according to one embodiment of the present invention.
Figure 2:
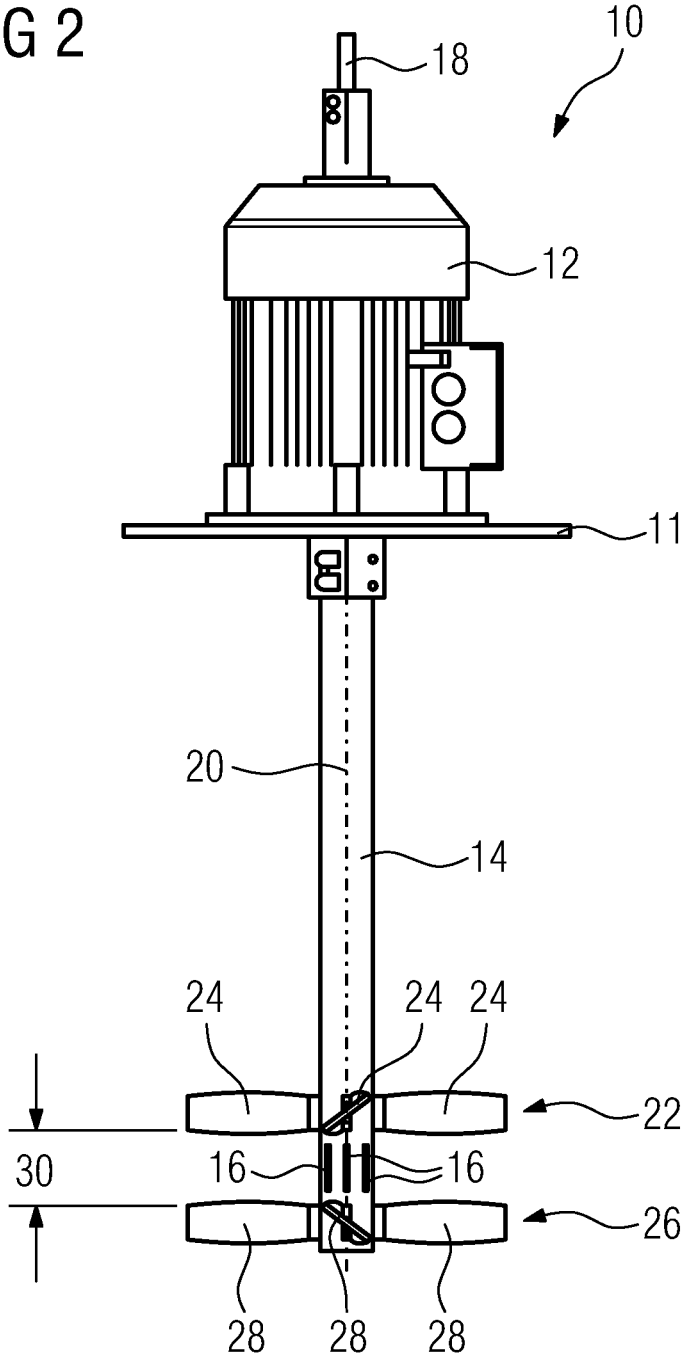
FIG. 2 is a side view of the stirrer illustrated in FIG. 1.
Figure 3:
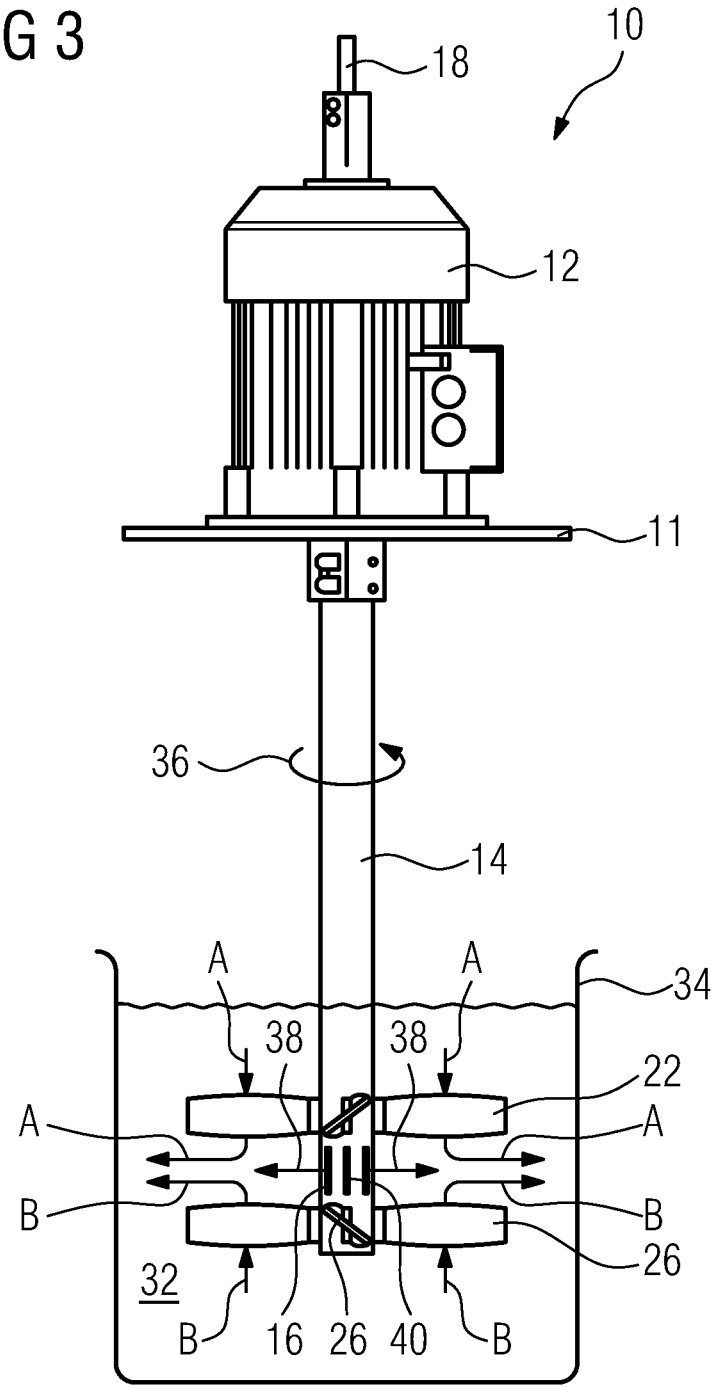
FIG. 3 is a side view of the stirrer illustrated in FIGS. 1 and 2, which has been dipped into a wastewater channel.

FIGS. 1 to 3 show a stirrer 10 according to one embodiment of the present invention. The stirrer 10 comprises an electric motor 12 fastened to a mounting plate 11 and a hollow shaft 14 that is drivable via the motor 12. The hollow shaft 14 is formed entirely from plastics material or from metal material, e.g. a steel, having a coating that is resistant to the additive, in particular a plastics coating. In the region of its free end, the hollow shaft 14 is provided with a multiplicity of additive outlet openings 16. Via these additive outlet openings 16, an additive can be discharged through the hollow shaft 14, said additive being fed via a non-co-rotating feed tube 40 which is guided within the hollow shaft 14, the upper end of said feed tube 40 projecting upwardly as an additive feed line 18 and being attached on the opposite side of the motor 12 from the hollow shaft 14. The end of the feed tube 40 opens out at the level of the additive outlet openings 16. The additive outlet openings 16 are axial elongate cutouts which are arranged in a regularly distributed manner along the circumference of the hollow shaft 14 and extend in each case in the direction of the hollow shaft axis 20.

Furthermore, the stirrer 10 comprises a first rotor 22, which has four rotor blades 24, and also a second rotor 26, which is provided with four rotor blades 28. The rotors 22 and 26, which are produced from plastics material, are connected to the hollow shaft 14 so as to rotate therewith and are arranged at a distance from one another so that they define between one another an intermediate space 30, in which the additive outlet openings 16 are positioned. The rotor blades 24 of the first rotor 22 and the rotor blades 28 of the second rotor 26 are arranged so as to move in opposite directions, that is to say are inclined in opposite directions, so that they generate substantially opposite flows during operation.

The mode of operation of the stirrer 10 is explained in the following text with reference to FIG. 3.

If the free end of the hollow shaft 14 having the rotors 22 and 26 retained thereon is dipped into a wastewater channel 34 filled with wastewater 32, as is illustrated in FIG. 3, and the hollow shaft 14 is then driven with the aid of the motor 12 in the direction of rotation indicated by the arrow 36, the flow A is generated within the wastewater 32 by the first rotor 22 and the flow B is generated by the second rotor 26, as is indicated by the corresponding arrows. In other words, by driving the first rotor 22 wastewater is sucked into the intermediate space 30 from above, while the second rotor 26 sucks or guides wastewater into the intermediate space 30 from below, thereby producing a negative pressure in the intermediate space 30. The wastewater sucked into the intermediate space 30 is then pushed radially outward out of the intermediate space 30, so that a centrifugal force is additionally generated in the intermediate space 30. In this way, good intermixing of the wastewater 32 to be treated is achieved. In addition, the additive fed via the hollow shaft 14 is sucked continuously out of the additive outlet openings 16, as is indicated by the arrows 38, thereby ensuring uniform admixture of the additive.

The additive may be for example iron chloride ($FeCl_3$), which is used for phosphate elimination in the wastewater.

The above-described structure of the stirrer 10 is advantageous in particular to the extent that, with a very simple structure, very good intermixing of the medium to be treated and proper introduction of the additive can be ensured.

LIST OF REFERENCE SYMBOLS

10 Stirrer
11 Mounting plate
12 Motor
14 Hollow shaft
16 Additive outlet opening
18 Additive feed line
20 Hollow shaft axis
22 First rotor
24 Rotor blade
26 Second rotor
28 Rotor blade
30 Intermediate space
32 Wastewater
34 Wastewater channel
36 Arrow
38 Arrow
40 Feed tube

I claim:

1. A stirrer having:

a motor;

a hollow shaft that is drivable via the motor and is provided with at least one additive outlet opening, via which an additive passed through the hollow shaft or a feed tube guided therein can be discharged;

a first rotor arranged on the hollow shaft and having a first plurality of rotor blades disposed about the circumference of the hollow shaft, the first plurality of rotor blades having suction sides facing in a first axial direction with respect to the hollow shaft, and the first plurality of rotor blades having pressure sides facing in a second axial direction with respect to the hollow shaft; and a second rotor arranged on the hollow shaft at a distance from the first rotor and having a second plurality of rotor blades disposed about the circumference of the hollow shaft, the second plurality of rotor blades having suction sides facing in the second axial direction with respect to the hollow shaft, and the second plurality of rotor blades having pressure sides facing in the first axial direction with respect to the hollow shaft wherein the at least one additive outlet opening is provided between the two rotors; and the rotors are designed and drivable such that, during operation, a negative pressure and a centrifugal force are generated in an intermediate space defined between the rotors.

2. The stirrer as claimed in claim 1, wherein the rotors are connected to the hollow shaft so as to rotate therewith.

3. The stirrer as claimed in claim 1, wherein the rotor blades of the first rotor and the rotor blades of the second rotor are arranged so as to move in opposite directions or are inclined in opposite directions or produce opposite flows.

4. The stirrer as claimed in claim 1, wherein the rotors are arranged in the region of the free end of the hollow shaft.

5. The stirrer as claimed in claim 1, wherein the hollow shaft and the rotor blades of the first rotor and of the second rotor are produced from plastics material.

6. The stirrer as claimed in claim 1, wherein the at least one additive outlet opening is an elongate cutout.

7. The stirrer as claimed in claim 1, further comprising a plurality of additive outlet openings, which are arranged in a regularly distributed manner along the circumference of the hollow shaft.

8. The stirrer as claimed in claim 1, wherein the motor is an electric motor and/or is fastened to a mounting plate.

9. The stirrer as claimed in claim 1, wherein:

the hollow shaft and the motor are arranged coaxially; and an additive feed line is connected to the motor.

10. The stirrer as claimed in claim 1, wherein the suction sides of the rotors face away from one another and the pressure sides of the rotors are provided between the rotors.

11. The stirrer as claimed in claim 6, wherein the elongate cutout extends in the direction of the hollow shaft axis.

12. The stirrer as claimed in claim 9, wherein the additive feed line is connected to the opposite side of the motor from the hollow shaft.

13. The stirrer as claim in claim 1, wherein the rotor blades of the first plurality of rotor blades are discreet rotor blades that are spaced apart from one another about the circumference of the hollow shaft such that fluid may flow therebetween in a direction generally aligned with the axis of the hollow shaft.

14. The stirrer as claim in claim 1, wherein the rotor blades of the second plurality of rotor blades are discreet rotor blades that are spaced apart from one another about the circumference of the hollow shaft such that fluid may flow therebetween in a direction generally aligned with the axis of the hollow shaft.

* * * * *